United States Patent [19]

Smith

[11] 4,377,271

[45] Mar. 22, 1983

[54] COLLAPSIBLE BINDERS AND THE LIKE

[76] Inventor: Donald B. Smith, R.R. No. 1, Mount Brydges, Ontario, Canada, N0L 1W0

[21] Appl. No.: 154,149

[22] Filed: May 28, 1980

[51] Int. Cl.[3] ..... A47B 97/04

[52] U.S. Cl. ..... 248/460

[58] Field of Search ..... 248/174, 459, 460; 402/72; 281/33, 42

[56] References Cited

U.S. PATENT DOCUMENTS

| | | | |
|---|---|---|---|
| Re. 21,371 | 2/1940 | Barrett | 248/460 X |
| 2,256,513 | 9/1941 | Bauer | 281/33 |
| 2,587,316 | 2/1952 | Henry | 248/459 |
| 3,383,120 | 5/1968 | Guiles | 281/33 |
| 3,990,669 | 11/1976 | Smith | 248/459 |

*Primary Examiner*—William H. Schultz

*Attorney, Agent, or Firm*—Weldon F. Green

[57] ABSTRACT

The invention relates to improvements in collapsible binders and the like, which are self-sustaining in a predetermined configuration when unfolded and extended to sit upon a flat surface, such a binder presenting an elongated central panel flanked by a pair of generally quadrilateral flanking side panels with a rearwardly located collapsible support having an upstanding elongated rear central panel flanked by a first pair of upstanding rear-side panels of substantially right-angled triangular configuration the later side panels terminating along their respective hypotenuses remote from said upstanding rear central panel in a second pair respectively of flanking side panels extending in coplanar relation behind the flanking side panels of said binder, and slidingly fixed thereto; and with all panels being so hingedly connected together that the structure may upon being unfolded extend into its self-sustaining predetermined configuration and may be compactly folded up when collapsed for storage or for carrying.

8 Claims, 5 Drawing Figures

COLLAPSIBLE BINDERS AND THE LIKE

FIELD OF INVENTION

This invention relates to improvements in lightweight collapsible support structures and more particularly to those structures that include book covers or ring binders and the like as integral parts thereof for displaying the contents thereof or serving as an easel or other similar purpose.

BACKGROUND TO THE INVENTION

Lightweight collapsible structures useful for a variety of purposes have been disclosed in a number of United States patents and Canadian patents exemplified by the following:

U.S. Pat. No. 433,635 issued August 1890;
U.S. Pat. No. 844,066 issued February 1907;
U.S. Pat. No. 1,875,460 issued September 1932;
U.S. Pat. No. Re. 21,371 issued February 1940;
U.S. Pat. No. 2,587,316 issued February 1952;
Can. Pat. No. 312,291 issued June 1931;
Can. Pat. No. 315,615 issued Sept. 29, 1931;
Can. Pat. No. 641,733 issued May 1962.

This invention relates to improvements in such collapsible structures but particularly of the nature disclosed in my U.S. Pat. No. 3,990,669 which issued Nov. 9, 1976 and the Canadian counterpart, Canadian Pat. No. 1,010,008 issued May 10, 1977.

OBJECTS OF THE INVENTION

The principal object of this invention is to provide an improved self-sustaining lightweight collapsible support structure for a book cover or binder which is integrally associated therewith so that it is adapted, if desired, upon the book cover or binder being extended from a closed or folded position to a substantially fully extended open position to be supported upon a suitable surface in inclined erect stable configuration in order that its contents can be readily displayed or the cover used as an inclined working surface or easel.

More particularly, it is an object of this invention to provide a collapsible support structure which will fold compactly with the book cover or binder either for carrying same or for storage and upon opening of the book cover or binder move automatically with the book cover or binder to assume an independently erect stable configuration when the cover or binder has reached the fully open position.

Another important object is to provide a collapsible support structure of relative simplicity easily manipulated from its folded or compact state into the independently erect stable configuration.

Still another object is to provide a collapsible support structure which in the fully extended position can be releasably locked in place to preserve its stability.

Still another important object is to provide a cover or binder with support structure disposed therebelow thereby providing for ready viewing of the contents thereof or presenting a clear work surface and avoiding interference with enclosed pages or work sheets or the like when folded up.

Still another very important object is to provide a support structure capable of being fabricated from low cost lightweight material using basic manufacturing steps and available apparatus requiring low labour content so as to ensure efficiency of production and reduce costs of manufacture.

FEATURES OF THE INVENTION

One feature of the invention resides in providing in combination with a cover, suitable as a book cover or as a binder or the like, which includes a stiff central panel portion or spine of generally uniform quadrilateral perimetral configuration arranged so as to present upper, lower and side edges and a pair of stiff side panel portions flanking the central panel portion and hingedly connected thereto along opposite side edges for swinging movement from a fully closed with the side panel portions in opposed relation position to a fully open position with the panel portions in extended side-by-side coplanar relation and reversely, of a collapsible structure for supporting the fully opened cover from below and in inclined relation upon a suitable surface including a central strut located rearwardly and hingedly connected adjacent its upper edge to the central panel portion of the cover to swing from a position thereagainst to a substantially upright position therebelow, the central strut carrying shiftable side strut formations extending to and supporting each of the side panel portions of the cover formation and adapted to move with the central strut and central and side panel portions of the cover from the closed to the fully opened position and reversely with the shiftable side strut formations releasably anchorable against displacement with the cover formation in at least the fully opened position to stabilize the structure.

It is to be understood that with such arrangement, the collapsible structure through manipulation closely embraces the cover when closed and automatically assumes an extended erect stable configuration locked against collapse when the cover is fully opened.

Another feature resides in providing shiftable side struts that include reinforcing panel portions hingedly connected along fold axes lying substantially in the plane of the respective side panel portions of the cover so as to slidingly abut therebelow over the range of movement of the central strut and associated panel portions of the cover from the folded position to the substantially fully extended position and reversely. Thus it will be appreciated that not only may a book or binder include an integral collapsible supporting structure but one of substantial strength so as to better resist deformation or collapse in the fully erect disposition.

More particularly, it is another feature of this invention that each flanking side panel of the cover formation include an elongated slot formation of selected configuration so as to present a channel formation with corresponding locking pockets at the remote ends thereof to guide follower members presented by respective shiftable side strut formations throughout the range of relative movement of the components with the locking pockets and cooperating follower members being adapted to secure the components against dislodgment not only in the fully extended position but in the fully folded position so as to ensure uniform displacement and avoid distortion in use.

Still another feature resides in providing support structures which can be derived from substantially rigid sheetlike panels having a reproducible perimetral configuration so that they can be struck from flattened sheets of material in a conventional die cutting or stamping operation and in which fold axes can be simultaneously impressed or scored to define the several hinge connections.

These and other objects and features are revealed in the following description which is to be read in conjunction with the sheets of drawings in which.

DESCRIPTION OF THE INVENTION

Figure 1:
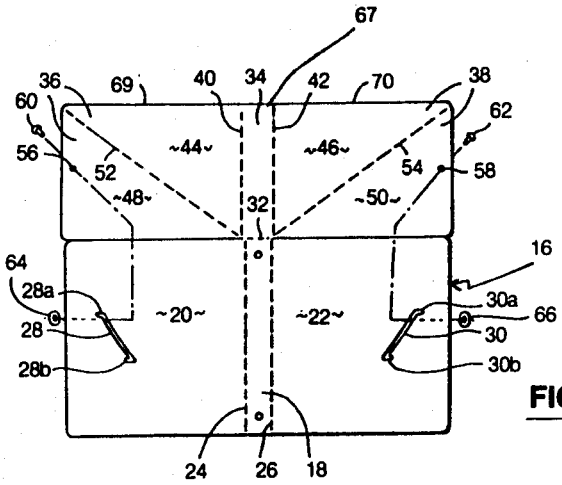
FIG. 1 is a plan view of a preferred one piece layout or blank from which structures embodying the invention can be derived.

The preferred embodiment of the invention as illustrated in FIGS. 2 to 5 inclusive of the drawings takes the form of a ring binder formation 12 provided with a collapsible support structure indicated generally at 14, the components of same preferably being integral and derived from a blank or layout 16 illustrated in FIG. 1.

The blank or layout 16 is struck from a suitable sheet of stiff plastic, for example, polyethelyne of a selected thickness so as to ensure stability of the structure. The layout 16 includes a first central panel portion 18 separated from flanking side panel portions 20, 22 by fold axes indicated by broken lines 24, 26 which are provided either by compressing the plastic sheet linearly during the die cutting operation or by inscribing the layout with suitable knife edges in another step.

Elongated slots 28, 30 extend through side panel portions 20, 22 in a somewhat diagonal direction slots 28, 30 having in the preferred embodiment opposite symmetry and each terminating at their remote ends in anchoring pockets **28*a*, 28*b* and 30*a*, 30*b*** respectively for a purpose to be explained.

Figure 2:
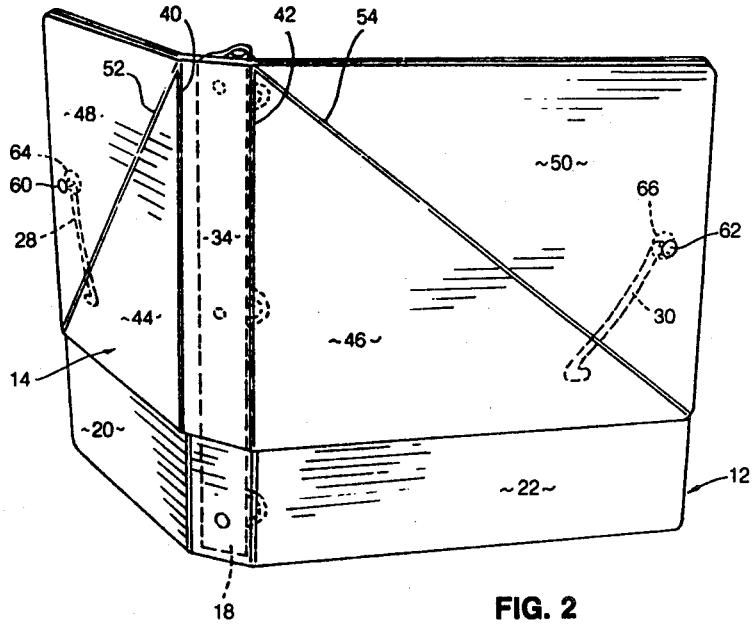
FIG. 2 is a perspective view taken from the rear of a combined cover formation and collapsible support structure derived from the layout of FIG. 1.

Hinged by an impressed or an inscribed fold axis 32 to the upper edge of central panel portion 18 is an elongated strut or panel portion 34 which is adapted to abut up against the rear surface of central panel portion 18 in the manner revealed by FIG. 2.

Two side strut formations 36, 38 flank central strut 34 and are separated therefrom by impressed or inscribed fold axes 40, 42 which are parallel and in the preferred embodiment illustrated in the drawings slightly more widely separated than parallel fold axes 24, 26 separating side panel portions 20, 22 from central panel portion 18.

Strut formations 36, 38 include gusset panel portions 44, 46 respectively which present reinforcing panel portions 48, 50 being separated from gusset panel portions 44, 46 by impressed or inscribed fold axes 52, 54.

Figure 3:
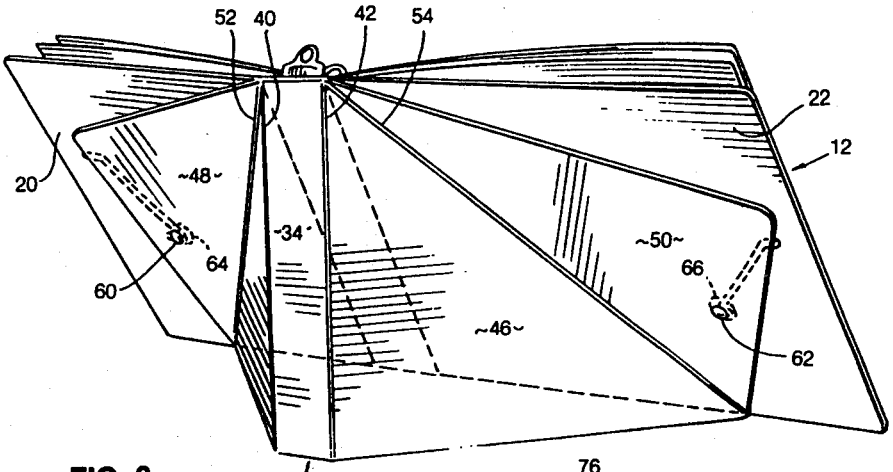
FIG. 3 is a perspective view of the structure of FIG. 2 with the cover formation and collapsible support structure in the fully extended position.

It is to be appreciated that the fold axes 52, 54 extend diagonally from the intersection of respective fold axes 40, 42 and fold axis 32 whereby as best seen in FIG. 3 reinforcing panel portions 48, 50 can abut the rear surfaces of side panel portions 20, 22 in the disposition illustrated.

Reinforcing panel portions 48, 50 are each provided with openings therethrough as at 56, 58 respectively in which follower pins 60, 62 are adapted to be achored, as illustrated in FIGS. 2 to 5 inclusive.

Follower pins 60, 62 include head portions **60*a*, 62*a* respectively and suitably dimensioned shank portions 60*b* and 62*b* respectively which shank portions are adapted to be disposed within elongated slots 28, 30 for sliding movement therealong and secured against withdrawal therefrom by means of locking washers 64, 66 respectively fitted over and suitably secured to the ends of shank portions 60*b*, 62*b* remote from the head portions 60*a*, 62*a* in a manner so as to closely draw washers 64, 66 against the forward surfaces of side panel portions 20, 22**.

It wil be understood that follower pins 60, 62 register within anchoring pockets **28*a*, 30*a* respectively of slots 28, 30 when the supporting structure 14 is collapsed against the rear surfaces of central and flanking panel portions 18, 20, 22 of ring binder 12 as shown in FIG. 2**.

Further, it will be understood that follower pins 60, 62 register within locking pockets **28*b*, 30*b* respectively of slots 28, 30 when the supporting structure 14 is in the fully erect extended position and depends rearwardly below the inclined central and flanking panel portions 18, 20, 22 of ring binder 12 as revealed particularly by FIG. 3 and FIG. 5** of the drawings.

It will be observed in FIG. 2 that the ring binder formation 12 is disposed so that the central and flanking side panel portions 18, 20, 22 are not fully extended. In such disposition the collapsible support structure 14 tends to lie next adjacent the rearward surfaces thereof suspended from fold axis 32 hinging elongated strut or panel portion 34 to the upper edge of central panel portion 18.

Additionally, the flanking side panel portions 20, 22 and flanking side strut formations 36, 38 are held against separation by the follower pins 60, 62 registered within upper locating pockets **28*a*, 30*a* of elongated slots 28, 30**.

It will be understood that the fold axes 24, 26 of ring binder formation 12 and the fold axes 40, 42 of collapsible support structure 14 are substantially coterminous in the disposition shown in FIG. 2 so that the composite article moves as a unit towards the fully closed or folded position. Thus, it is readily apparent that the composite folded article can be treated simply as a binder and handled in the usual manner.

Supporting structure 14 illustrated in FIG. 3 is shown fully extended having been displaced rearwardly by opening wide ring binder 12 to bring flanking side panel portions 20, 22 into side-by-side coplanar relation with central panel portion 18.

Follower pins 60, 62 carried by the shiftable strut formations 36, 38 and registered in upper anchoring pockets **28*a*, 30*a* as shown in FIG. 2 by slight shifting inwardly of respective panel portions 20, 22 are released therefrom and are guided by the narrow channels presented by elongated slots 28, 30 under displacement downwardly in a somewhat diagonal direction towards lowermost anchoring pockets 28*b*, 30*b***.

Figure 5:
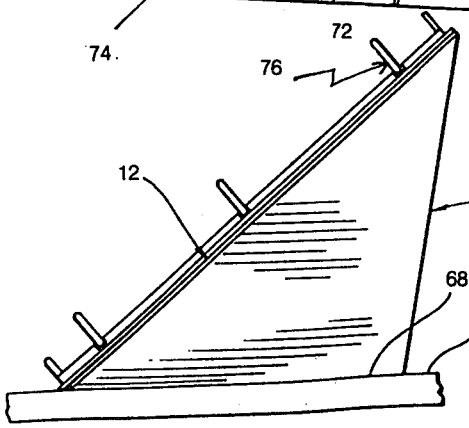
FIG. 5 is a side elevational view of the embodiment of FIGS. 3 and 4 taken from the left in FIG. 3 and from the right in FIG. 4.

Such movement swings central strut 34 rearwardly downwardly about fold axis 32 to present its lowermost edge 67 to a supporting surface 68 of a desk 80 as revealed by FIG. 5 and draws associated flanking side strut formations 36, 38 with it likewise presenting their lowermost edges 69, 70 respectively to surface 68.

Follower pins 60, 62 at the lowermost extent of their travel within slots 28, 30 are presented to anchoring pockets **28*b*, 30*b* and by slightly shifting panel portions 20, 22 are urged into interlocking relation therewith so that central and side panel portions 18, 20, 22** respectively are held against dislodgment in substantially fully extended side-by-side coplanar relation.

Figure 4:
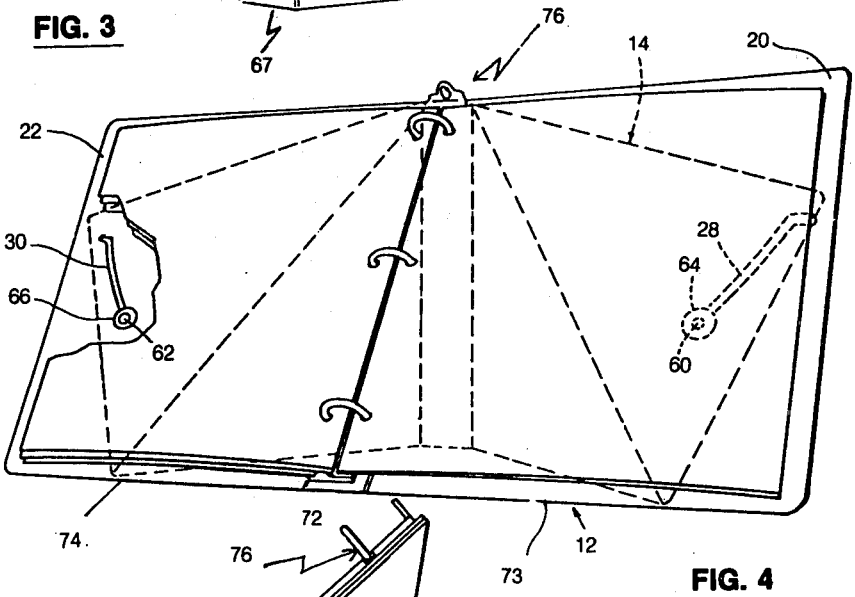
FIG. 4 is a perspective view of the embodiment of FIG. 3 taken from the front.

The extended configuration exhibited by the preferred embodiment of the composite article of FIGS. 3, 4 and 5 of the drawings likewise place the lowermost edges 72, 73, 74 of coplanar panel portions 18, 20, 22 in contact with surface 80 and with follower pins 60, 62 located within anchoring pockets 28*b*, 30*b* the entire structure is rigidified and assumes a substantial measure of stability.

So extended, the composite article illustrated exposes the contents of the ring binder 12 for examination or for viewing in the style of an easel or presents a work or display surface for any suitable purpose.

The conventional three-ring structure 76 of binder 12 in the several FIGS. 2 and 5 inclusive is optional but desirable where the structure is used as a notebook, since the pages when turned tend to lie flat against the inclined surfaces presented by the coplanar panel portions 18, 20, 22.

Removal of the three-ring structure 76 provides an extended flat surface for the mounting of drawings or for the displaying of products and the like.

It will be observed that the outermost panel portions 48, 50 of collapsible support structure 14 are constrained by respective slots 29, 30 and follower pins 60, 62 and associated components in sliding abutment against the rearward surfaces of flanking side panel portions 20, 22 throughout the range of movement from the disposition or attitude of FIG. 2 to that of FIGS. 3 and 4.

This arrangement dictates controlled movement of the components so that whether the support structure 14 is seized and moved either into the collapsed or extended position the associated binder formation 12 is correspondingly displaced. Likewise, if the binder formation 12 is displaced the support structure 14 is correspondingly altered.

The positioning of slots 28, 30 is selected in the preferred embodiment so that they are as widely separated as possible which tends to afford maximum resistance of the erected article to deformation or collapse. Moreover, the strength of the composite article can be enhanced through the selection of more rigid or thicker sheet material for the integral panel portions.

It is also to be understood that the several panel portions derived from an integral sheet as revealed by FIG. 1 can be separate and appropriately hinged together in any suitable manner but that a one-piece blank or layout as revealed by FIG. 1 is preferred in that it minimizes costs.

The inclination of the binder panel portions 18, 20, 22 in the fully extended disposition of FIGS. 3, 4 and 5 can be altered by adjusting the relative dimensions of the respective front panel portions 18, 20, 22 of binder formation 12 and central strut 34 of the support structure 14 as by extending central strut 34 and associated flanking side strut formations 36, 38 for example, to achieve a more upright disposition and vice versa.

It is understood that variations or modifications can be introduced into the preferred embodiment illustrated and described herein by those persons skilled in this field without departing from the spirit and scope of the invention as defined in the appended claims.

What I claim is:

1. In a collapsible support structure the combination with a cover formation including a stiff central panel portion of generally uniform quadrilateral perimetral configuration arranged so as to present upper, lower and side edges and a pair of stiff side panel portions flanking said central panel portion and hingedly connected thereto along opposite side edges for swinging movement from a fully closed position with side panel portion in opposed relation to a substantially fully extended open position in side-by-side coplanar relation with said stiff central panel portion and reversely, of means for supporting said cover formation in inclined relation from below with said aforementioned panel portions disposed in substantially fully extended open position, said supporting means including stiff central strut means having upper lower and side edges hingedly interconnected adjacent its upper edge to said central panel portion to swing from a position thereagainst to a substantially upright position therebelow and shiftable stiff side strut means extending between each side panel portions of said cover and said central strut means and interengageable means presented by said shiftable side strut means and said side panel portions respectively to each other for interengaged relative sliding movement therebetween upon swinging movement from said fully closed position to said fully extended open position and reversely and for releasably anchoring same against displacement when said side panel portions are disposed in substantially coplanar side-by-side inclined relation with said stiff central panel portion.

2. A collapsible support structure according to claim 1 in which each said shiftable side strut means includes a panel portion hingedly supported along a fold axis lying substantially in the plane of its respective side panel portion of the cover and remote from said first mentioned central strut means so as to slidingly abut its respective side panel portion from below over the range of movement of said central strut means from a folded position against said central panel portion and with said cover formation in the closed position to said substantially upright position therebelow and with said cover formation in the fully open position, with said anchoring means being presented by and extending between said hingedly supported panel portions and said respective side panel portions.

3. A collapsible support structure according to claim 2 in which each said shiftable side strut means includes gusset panel portion means hingedly interconnecting said hingedly supported panel portion to said central strut means.

4. A collapsible support structure according to claim 3 in which said anchoring means comprises contoured slot means and slot follower means for engaging in said contoured slot means and following same under relative displacement, said contoured slot means having an extent and configuration such that with relative movement of said central and shiftable side strut means of said supporting means the same are displaced uniformly under swinging movement into and out of said substantially fully extended open position.

5. A collapsible support structure according to claim 4 in which each of said side panel portions presents contoured slot means and each of said hingedly supported panel portion presents said slot follower means.

6. A collapsible support structure according to claim 4 or 5 in which each of said contoured slot means is provided with anchoring pockets at its remote ends and offset in relation to the general direction of said slot means whereby said slot follower means are anchorable in said pockets when said cover formation is closed and when said cover formation is fully opened.

7. A collapsible support structure according to claims 1, 2 or 3 in said stiff central strut means is hingedly interconnected to the upper edge of said first mentioned stiff central panel portion.

8. A collapsible support structure according to claims 1, 2 or 3 in which said cover formation and associated supporting means comprise a one-piece layout derived from suitable sheet material.

* * * * *